US010576524B1

(12) United States Patent
Yuan et al.

(10) Patent No.: US 10,576,524 B1
(45) Date of Patent: Mar. 3, 2020

(54) DIE CAPABLE OF ACHIEVING RAPID FORMING AND QUENCHING THEREIN

(71) Applicants: Dalian University of Technology, Dalian, Liaoning Province (CN); Harbin Institute of Technology, Harbin, Heilongjiang (CN)

(72) Inventors: Shijian Yuan, Heilongjiang (CN); Zhubin He, Dalian (CN); Xiaobo Fan, Dalian (CN); Yanli Lin, Dalian (CN); Guofeng Wang, Heilongjiang (CN); Chang Qi, Dalian (CN)

(73) Assignees: DALIAN UNIVERSITY OF TECHNOLOGY, Dalian (CN); HARBIN INSTITUTE OF TECHNOLOGY, Harbin, Heilongjian (CN)

( * ) Notice: Subject to any disclaimer, the term of this patent is extended or adjusted under 35 U.S.C. 154(b) by 0 days.

(21) Appl. No.: 16/537,382

(22) Filed: Aug. 9, 2019

(30) Foreign Application Priority Data

Nov. 28, 2018 (CN) ..... 2018 1 1438289

(51) Int. Cl.

| | |
|---|---|
| ***B21D 37/16*** | (2006.01) |
| ***B21D 37/02*** | (2006.01) |
| ***B21D 22/02*** | (2006.01) |
| ***B21D 37/08*** | (2006.01) |
| ***C21D 1/673*** | (2006.01) |

(52) U.S. Cl.
CPC ..... *B21D 37/16* (2013.01); *B21D 22/022* (2013.01); *B21D 37/02* (2013.01); *B21D 37/08* (2013.01); *C21D 1/673* (2013.01)

(58) Field of Classification Search
CPC .... B21D 22/022; B21D 22/20; B21D 22/208; B21D 22/22; B21D 24/04; B21D 37/16; C21D 1/673
See application file for complete search history.

(56) References Cited

U.S. PATENT DOCUMENTS

| | | | | |
|---|---|---|---|---|
| 4,356,717 A * | 11/1982 | Okunishi | B21K 1/32 | 72/334 |
| 6,209,847 B1 * | 4/2001 | Frul | B29C 33/38 | 249/111 |
| 8,480,823 B1 * | 7/2013 | Matsen | B21D 37/16 | 148/574 |
| 2004/0103709 A1 * | 6/2004 | Manuel | B21D 37/16 | 72/342.3 |

(Continued)

FOREIGN PATENT DOCUMENTS

CN 102615201 A 8/2012

*Primary Examiner* — Edward T Tolan
(74) *Attorney, Agent, or Firm* — Innovation Capital Law Group, LLP; Vic Lin

(57) ABSTRACT

The present invention provides a die capable of achieving rapid forming and quenching therein. The die includes an upper die, a blank holder and a lower die, where the upper die is composed of an internal solid die core and a thin-walled skin. Grooves in communication with each other are disposed between the internal solid die core and the thin-walled skin. In a forming stage, the grooves are not filled or filled with a heat insulating material such as a gas; and in a quenching stage, a low-temperature medium is introduced into the grooves. The die can be used to achieve rapid forming and quenching of metal materials of different types and thicknesses.

2 Claims, 5 Drawing Sheets

(56) References Cited

U.S. PATENT DOCUMENTS

| | | | | |
|---|---|---|---|---|
| 2006/0059971 | A1* | 3/2006 | Vinnen | B21D 37/16 72/342.3 |
| 2009/0293571 | A1* | 12/2009 | Vehof | B21D 22/02 72/342.3 |
| 2013/0125603 | A1* | 5/2013 | Liu | B21D 37/16 72/342.3 |
| 2014/0069162 | A1* | 3/2014 | Fukuchi | B21D 22/208 72/342.2 |
| 2015/0075246 | A1* | 3/2015 | Dorr | B21D 22/201 72/347 |
| 2015/0107325 | A1* | 4/2015 | Glueck | B21D 37/16 72/342.3 |
| 2015/0121986 | A1* | 5/2015 | Yang | B21D 37/16 72/342.2 |
| 2016/0281185 | A1* | 9/2016 | Graf | B21D 53/88 |
| 2019/0100816 | A1* | 4/2019 | Seki | B21D 22/022 |

* cited by examiner

DIE CAPABLE OF ACHIEVING RAPID FORMING AND QUENCHING THEREIN

This application claims priority to Chinese application number 201811438289.X, filed Dec. 28, 2018, with a title of DIE CAPABLE OF ACHIEVING RAPID FORMING AND QUENCHING THEREIN. The above-mentioned patent application is incorporated herein by reference in its entirety.

TECHNICAL FIELD

The present invention relates to a die for forming a metal sheet part, and in particular to a die capable of rapidly forming and quenching a metal sheet part in the die.

BACKGROUND

For metal sheet parts (such as 2000 series, 6000 series, 7000 series aluminum alloy sheets and 22MnB5 boron steel sheets) capable of being thermally treated and strengthened, it is usually necessary to thermally treat and strengthen the formed parts (for aluminum alloy sheets, solution hardening is performed first to form a supersaturated solid solution, and then artificial aging precipitation strengthening is performed; 22MnB5 boron steel sheets are first heated and thermally insulated for austenization, and then rapidly quenched to form martensite). However, since the metal sheet parts need to undergo multiple heating and cooling during the heat treatment, the shapes and dimensions of the parts are easily changed due to uneven thermal expansion and contraction, thermal stress and internal stress in this process. In order to prevent or control the shape and dimensions changes of the parts during the heat treatment strengthening process, it is often necessary to use a complicated constraining tool to limit the sheet parts, or to perform the correction after the heat treatment strengthening is completed. This additionally increased subsequent processing inevitably results in a complicated forming process, poor consistency in shape and dimensions accuracy of parts, and low forming efficiency. For parts with complex shapes, even if the above treatment is performed, the required shape and dimensions accuracy often cannot be achieved.

In order to avoid the adverse effect of the heat treatment process on the shape and dimensions accuracy of the parts, a method for achieving metal sheet forming and heat treatment by using an identical die is provided; that is, by using the identical die, the forming of metal sheet parts is achieved first to obtain required shapes and dimensions, and then heat treatment is performed under the conditions of keeping the die closed to obtain required strength properties. Hot stamping of boron steel (such as 22MnB5) and hot stamping of aluminum alloys (such as 6061 and 7075) belong to this type of forming technology. During hot stamping, both an upper die and a lower die used are at lower temperatures (below 150° C.). A metal slab heated to a certain temperature is quickly placed on the die and die assembly is quickly performed to complete part forming. After the part is formed, cooling water is directly introduced into the closed upper die and lower die to lower the temperature of the die and the rapid cooling of the part is implemented by using a cold die. In the forming process, since a hot slab is cooled very quickly after contact with the upper die and the lower die that are cold. In order to ensure that the metal slab is at a sufficiently high temperature during the forming process to ensure good forming properties, it is required to complete the forming process in a very short time (1-3 s), which raises a high demand on a forming device. More importantly, the cold die and the hot metal slab are in partial contact for most of the time. The temperature distribution of the metal slab at a certain moment in the forming process is not conducive to the smooth forming of the entire part, which easily results in local forming defects such as partial wrinkles and cracks. Therefore, it is difficult to use this method for forming a complex-shaped metal sheet part.

In order to prevent or reduce the adverse effect of the cold die on hot metal sheet forming, the invention patent (patent title: METHOD FOR FORMING ALUMINUM ALLOY METAL SHEET PART BY USING COLD AND HOT COMPOUND DIE, patent number: ZL201210124230.X) proposes a solution of compounding of a cold die and a hot die, that is, the temperature of a metal slab in the forming process is slowed down by using a hot lower die to smoothly complete the formation of the part, and then the rapid cooling of the formed hot part is implemented by using a cold upper die. The method can reduce the mutual influence of the hot forming and the cooling quenching process to some extent, but still requires the hot forming process to be completed at a faster speed, and also needs to take necessary measures to ensure that the formed part and the cold upper die are in good contact to achieve effective quenching. This greatly limits the application of this method.

SUMMARY

The present invention provides a die capable of achieving rapid forming and quenching therein to solve the problem that in the process of hot forming of an existing metal sheet part, when a forming die is all cold (hot stamping) or a die on a side is cold (when a cold and hot compound die is formed), the rapid dropping of a local temperature of a hot metal slab occurs easily, so that the sheet forming property is affected, the forming process and the quenching process are coupled with each other and affect each other and cannot be reasonably coordinated.

The technical solution of the present invention is:

A die capable of achieving rapid forming and quenching therein, including an internal solid die core 1, a blank holder 8 and a lower die 10, where the internal solid die core 1 moves up and down in the blank holder 8; the lower surface of the internal solid die core 1 is provided with a plurality of upper grooves 6, and the upper grooves 6 are separated from each other through vertical ribs 4 integrated with the internal solid die core 1 and are in communication with each other; the upper surface of the internal solid die core 1 is provided with an upper leading-in hole 2 and an upper leading-out hole 5 which lead to the upper grooves 6, the upper leading-in hole 2 is used for filling the upper grooves 6 with a low-temperature medium, and the leading-out hole 5 is used for leading out the low-temperature medium after heat exchange; the surface of the upper grooves 6 is covered with an upper thin-walled skin 3, which is fixed on the internal solid die core 1; the lower surface of the upper thin-walled skin 3 is attached to the upper surface of a hot metal slab 9, and the hot metal slab 9 is quickly cooled and quenched after the forming is completed.

The inner surface of the lower die 10 is provided with a lower groove 12, and the lower groove 12 is arranged in the same manner as the upper groove 6, the surface of the lower groove 12 is covered with a lower thin-walled skin 13, which is fixed on the inner surface of the lower die 10; the lower die 10 is provided with a lower leading-in hole 14 and a lower leading-out hole 15 which lead to the lower groove 12, the lower leading-in hole 14 is used for injecting a low-temperature medium 7 into the lower groove 12, and the lower leading-out hole 15 is used for leading out the low-temperature medium 7 after heat exchange; after the forming is completed, the lower surface of the upper thin-walled skin 3 and the upper surface of the lower thin-walled skin 13 are simultaneously in contact with the hot metal slab 9, and the surface of the hot metal slab 9 is rapidly cooled to complete the quenching.

The shape and dimensions of the outer surface of the thin-walled skin are the same as those of a part to be formed, and the selected material is a stainless steel plate, a super-alloy plate or a titanium alloy plate, with a thickness of 0.2-0.5 mm. The thin-walled skin is in close contact with the vertical ribs 4 of the internal solid die core 1, and is not deformed during contact with the hot metal slab 9.

The depth of the groove is 2-10 mm, and the distance between adjacent vertical ribs 4 is 5-30 mm.

The working process of a die capable of achieving rapid forming and quenching therein is carried out according to the following steps:

step 1: according to the material type, complexity, precision requirements for a part to be formed, selecting a metal sheet of a corresponding type and thickness as a thin-walled skin, and using a slab made of a corresponding material as an internal solid die core 1;

step 2: preparing the internal solid die core 1 and machining an upper groove 3 on the surface thereof, and machining an upper leading-in hole 2 and an upper leading-out hole 5 on the side wall thereof;

step 3: preparing the metal sheet into a thin-walled skin matching the internal solid die core 1;

step 4: connecting the thin-walled skin to the internal solid die core 1, to form a combined forming die;

step 5: rapidly placing the heated hot metal slab 9 onto the forming die, and closing the die to complete the forming of the part;

step 6: keeping the die closed, and quickly introducing a low-temperature medium 7 into a channel composed of the thin-walled skin and the internal solid die core 1; and step 7: after maintaining a die assembly state for a certain period of time, opening the forming die, and taking out the formed part.

The beneficial effects of the present invention are as follows:

(1) The influence between forming and quenching is small: a die capable of achieving rapid forming and quenching therein according to the present invention can ensure that heat at a hot metal slab is not transferred in a large amount during the forming stage, thereby avoiding affecting the forming of the part; and in the quenching stage, rapid heat transfer between the hot metal slab and a low-temperature medium can be achieved by a thin-walled skin to achieve rapid cooling and quenching of the hot metal slab. Both the forming stage and the quenching stage can be completed in a sufficiently long time interval, and the influence between the forming process and the cooling process is small, so that the formation of complex parts and effective quenching thereof can be achieved.

(2) The skin is thin and has a small heat capacity, avoiding the cooling of the hot slab during forming: in the die capable of achieving rapid forming and quenching therein according to the present invention, since the skin is thin and has a small heat capacity, in the forming stage, when the hot metal slab is in contact with the skin, the skin does not conduct away a lot of heat from the hot metal slab, thereby avoiding causing a rapid drop in the temperature of the hot metal slab. The use of the die structure can not only avoid the temperature drop of the hot metal slab that is caused by the contact with a cold die and affects the forming property, but also avoid the unreasonable temperature distribution caused by the local temperature drop of the hot metal slab. Therefore, the hot metal slab can be deformed under a sufficiently high temperature and a reasonable temperature distribution.

(3) A die core adopts an ordinary die material: in the die capable of achieving rapid forming and quenching therein according to the present invention, an internal solid die core is not in directly contact with the hot metal slab, thereby avoiding serious friction and wear; the internal solid die core is only subjected to contact pressure from the thin-walled skin and is not required to have a high compressive strength. Therefore, the internal solid die core can be made of an ordinary cast iron material, and the internal solid die core can also be made of a hard plastic or a wood material in the sample piece pilot stage or when the forming quality is not high. With this die structure, the machining of the internal solid die core is very easy, so that the design and machining cycle of the die can be greatly shortened, and the die manufacturing cost can be greatly reduced.

(4) The use of an ordinary machining device: in the die capable of achieving rapid forming and quenching therein according to the present invention, the wall thickness of the skin is only 0.2-0.5 mm, and a thin-walled skin slab can be pressed using the internal solid die core to obtain a required final thin-walled skin. Since the skin is machined by using a sheet slab with a high surface quality, it is no longer necessary to use a precision machining device to ensure the surface roughness and the like of the skin. With this die structure, it is only necessary to roughly machine the shape of the internal solid die core and it is not necessary to use a precision milling machine and a grinding machine, so that the die manufacturing cycle can be greatly shortened, and the die manufacturing cost is greatly reduced.

(5) Rapid adjustment of the die is implemented: in the die capable of achieving rapid forming and quenching therein according to the present invention, since the thin-walled skin and the internal solid die core have a split combined structure, there is no connection or only simple connection between the two, and the thin-walled skin can be quickly removed from the internal solid die core. With this die structure, it is possible to avoid the reworking of the entire die caused by local wear of a die cavity or unreasonable partial design and the like. Moreover, when the thin-walled skin is worn, has an unsuitable thickness or has an unsuitable material, it is also very easy to replace the thin-walled skin.

(6) A groove is filled with a heat insulating material to further prevent cooling: in the die capable of achieving rapid forming and quenching therein according to the present invention, in the forming stage, a gas with certain pressure such as air or nitrogen is introduced into the groove between the thin-walled skin and the solid die core. Due to the poor thermal conductivity of the gas, the effective separation between the thin-walled skin and the solid die core can be achieved, the thin-walled skin which is in contact with and heated by the hot metal slab is prevented from exchanging a lot of heat with the solid die core, thereby ensuring that the heat of the hot metal slab is no longer transferred in large quantities, avoiding causing a drop in temperature.

(7) The skin is thin and has a small heat capacity, and thus rapid cooling and quenching can be achieved: in the die capable of achieving rapid forming and quenching therein according to the present invention, since the skin is thin and has a small heat capacity, in the quenching stage, the heat of the hot metal slab can be quickly transferred to a low-temperature medium on the other side through the thin-walled skin, and is quickly transferred as the low-temperature medium flows. With this die structure, the rapid cooling of the hot metal slab can be achieved, thereby ensuring effective quenching treatment of the hot metal slab.

(8) The forming of a sheet and a thick plate can be achieved: in the die capable of achieving rapid forming and quenching therein according to the present invention, the temperature of the metal slab in the forming stage does not rapidly decrease, and the material has low flow stress and high forming property in a hot state and can have sufficient time to form a part with a complex shape. Due to the rapid heat exchange between the low-temperature medium and the hot part during the quenching stage, a sufficiently high cooling rate and effective quenching can be achieved. Therefore, this die structure can be used not only for the forming and quenching of a plate with a medium thickness (a thickness of 0.5-5.0 mm), but also for the forming and quenching of a sheet (with a thickness of 0.2-0.5 mm) and a thick plate (with a thickness of 5-20 mm).

(9) The forming of different materials is achieved by using different skins: in the die capable of achieving rapid forming and quenching therein according to the present invention, the thin-walled skin can be reasonably selected according to the material type, wall thickness and forming temperature and the like of the formed metal slab. When the metal slab forming temperature is 200-450° C. (such as an aluminum alloy slab), a 304 or 306 stainless steel sheet can be used as the thin-walled skin. When the metal slab forming temperature is 500-900° C. (such as high-strength steel 22MnB5), a TC4 or TA2 titanium alloy sheet or a GH4169 superalloy sheet can be used as a thin-walled skin. With this die structure, the forming of different metal parts can be realized, and the range of applicable materials is wide.

(10) The quenching of different materials is achieved by using different low-temperature media: in the die capable of achieving rapid forming and quenching therein according to the present invention, different low-temperature media can be introduced into the groove between the thin-walled skin and the solid die core according to the quenching requirement for the formed metal slab. When the metal slab has a smaller wall thickness, ice water with a temperature of 5-10° C. can be introduced into the groove; when the metal slab has a larger wall thickness, cold air with a temperature of −50-−100° C. or liquid nitrogen with a temperature of −196° C. can be introduced into the groove. The use of the die structure can meet the quenching requirements for metal slabs made of different materials and with different wall thicknesses, and the range of applicable materials and parts is wide.

(11) A varying quenching effect is achieved by using different grooves: in the die capable of achieving rapid forming and quenching therein according to the present invention, a cooling channel is formed by a surface groove and a skin. Since the surface groove is easy to machine, a groove with a specific shape and dimensions can be machined on the surface of the internal solid die core and disposed as desired. With this die structure, different temperature distributions can be achieved in different regions of the thin-walled skin during the quenching phase, thereby achieving different cooling rates in different regions of the hot metal part, which makes it possible to obtain different mechanical property distributions by controlling quenching effects of different regions on the metal part.

In the figure: 1. internal solid die core, 2. upper leading-in hole, 3. upper thin-walled skin, 4. vertical rib, 5. upper leading-out hole, 6. upper groove, 7. low-temperature medium, 8. blank holder, 9. hot metal slab, 10. lower die, 11. initial filling gas; 12. lower groove; 13. lower thin-walled skin, 14. lower leading-in hole, 15. lower leading-out hole.

DETAILED DESCRIPTION

The specific embodiments of the present invention are further described below in conjunction with the accompanying drawings and technical solutions.

Embodiment 1

Figure 1:
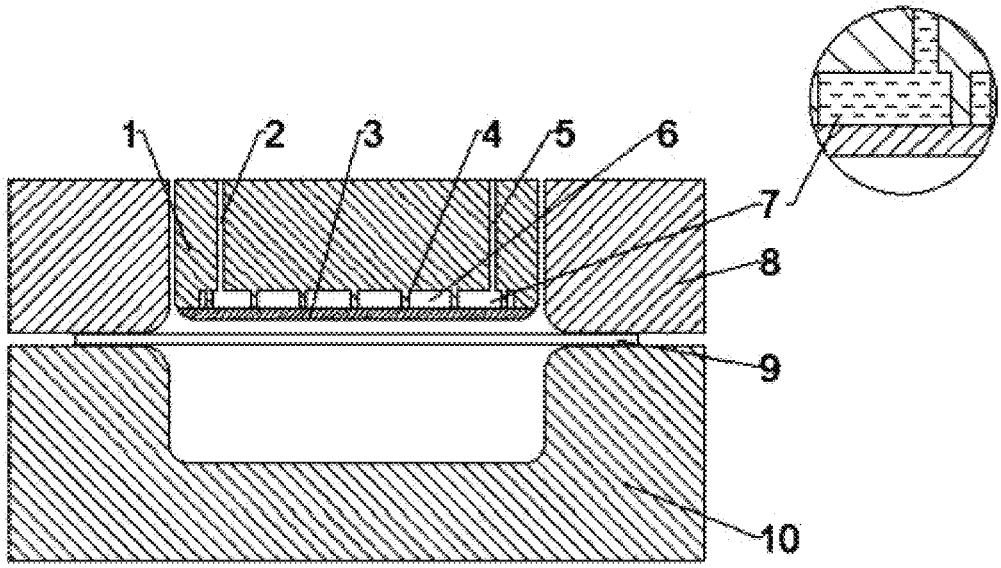
FIG. 1 is a schematic structural view of a die capable of achieving rapid forming and quenching therein according to the present invention.
Figure 2A:
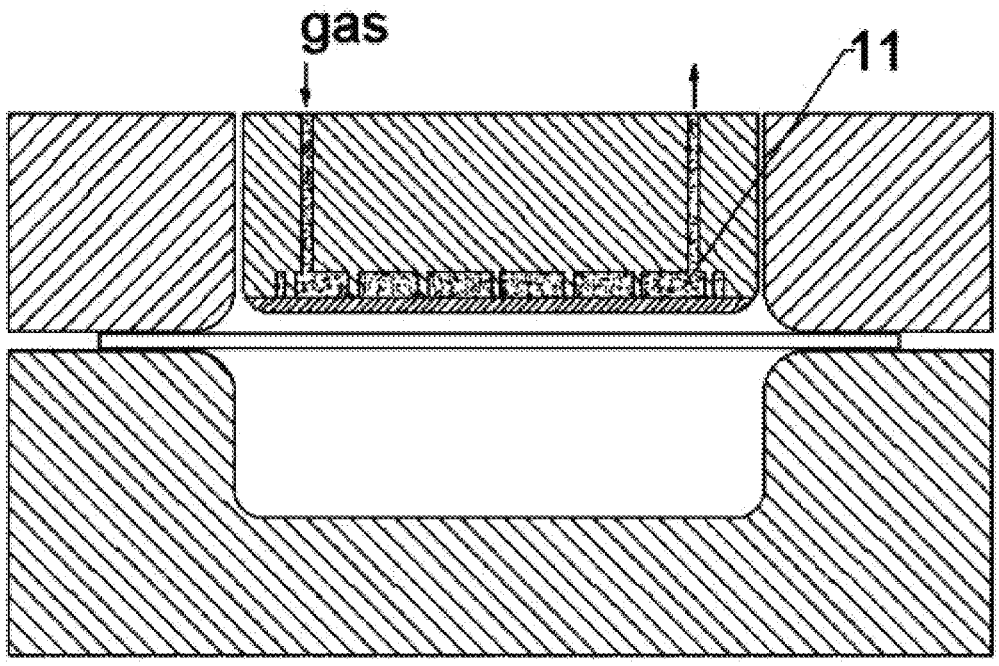
FIGS. 2A-2D are views showing the working principle of a die capable of achieving rapid forming and quenching therein according to the present invention.
Figure 2B:
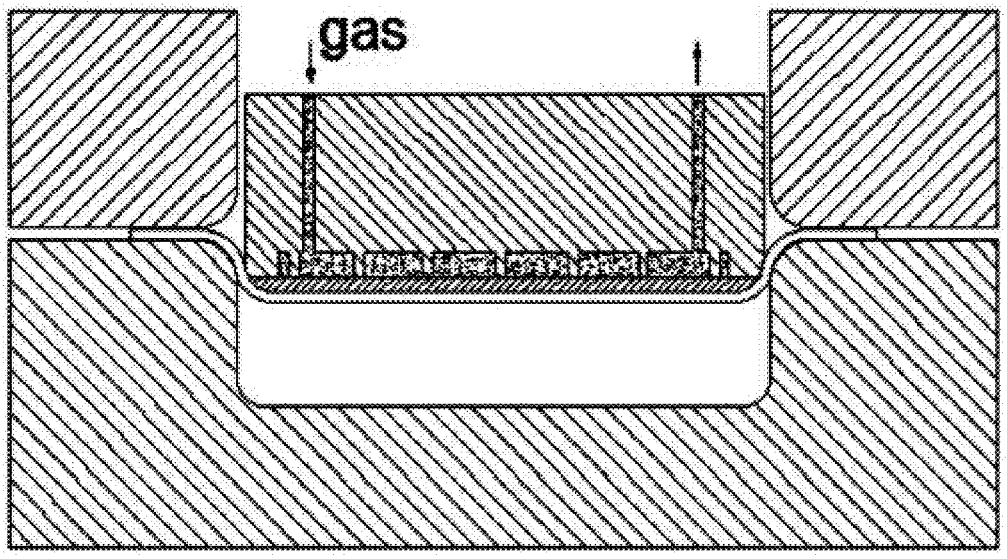
Figure 2C:
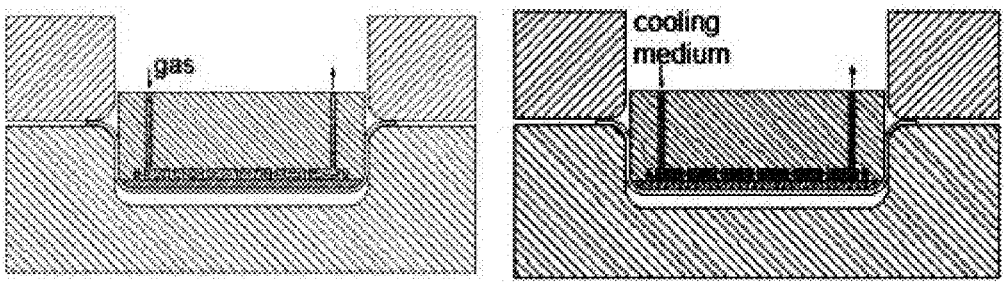
Figure 2D:
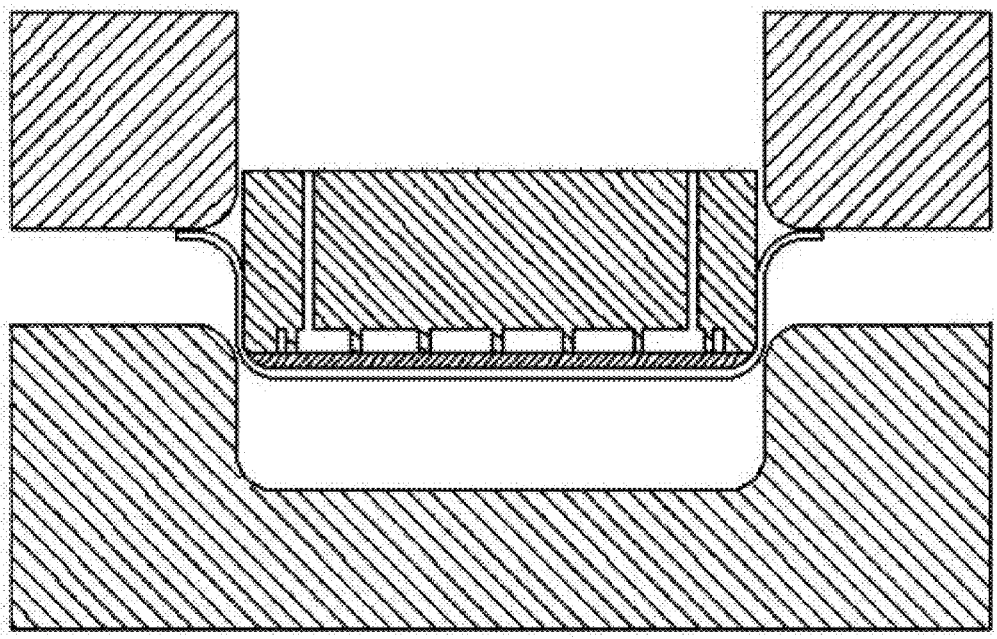

With reference to FIGS. 1 and 2, in a die capable of achieving rapid forming and quenching therein, (1) a forming die includes an upper die and a lower die, where the lower die has a conventional overall structure; (2) the upper die has a combined structure, which is composed of a thin-walled skin and an internal solid die core, and the thin-walled skin closely coats the internal solid die core; (3) the shape and dimensions of the outer surface of the thin-walled skin are the same as those of a part; (4) the surface of the internal solid die core is provided with vertical ribs and grooves communicated with each other, and a specific channel is formed after the thin-walled skin is in contact with the grooves; (5) the internal solid die core is provided with a medium leading-in hole and a leading-out hole, which are connected to the channel formed by the skin and the grooves.

The working process of the above die capable of achieving rapid forming and quenching therein is carried out according to the following steps:

Step 1: according to the material type, complexity, precision requirements for a metal sheet part to be formed, select a metal sheet of a corresponding type and thickness as a skin, and use a slab made of a corresponding material as a solid die core.

Step 2: prepare the internal solid die core and machine a groove on the surface thereof, and machine a leading-in hole and a leading-out hole on the side wall thereof.

Step 3: prepare a thin-walled skin slab into a thin-walled skin matching the internal solid die core.

Step 4: connect the thin-walled skin to the internal solid die core, to form a combined forming die.

Step 5: rapidly place the heated metal slab onto the forming die, and close the die to complete the forming of the part;

Step 6: keep the die closed, and quickly introduce a low-temperature medium into a channel composed of the thin-walled skin and the internal solid die core.

Step 7: after a die assembly state is maintained for a certain period of time, open the forming die, and take out the formed part.

Embodiment 2

Figure 3:
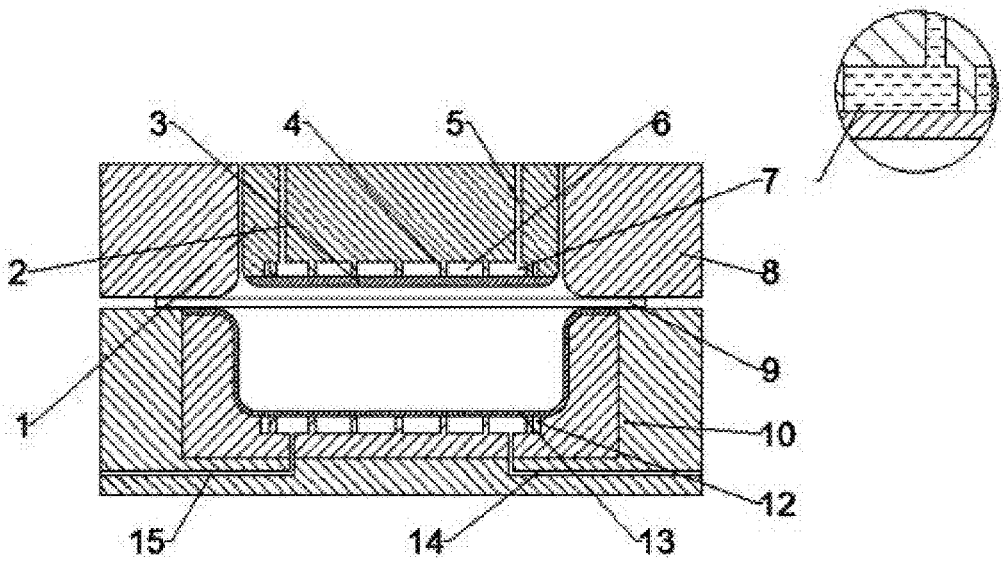
FIG. 3 is a schematic structural view of a second die of a die capable of achieving rapid forming and quenching therein according to the present invention.
Figure 4A:
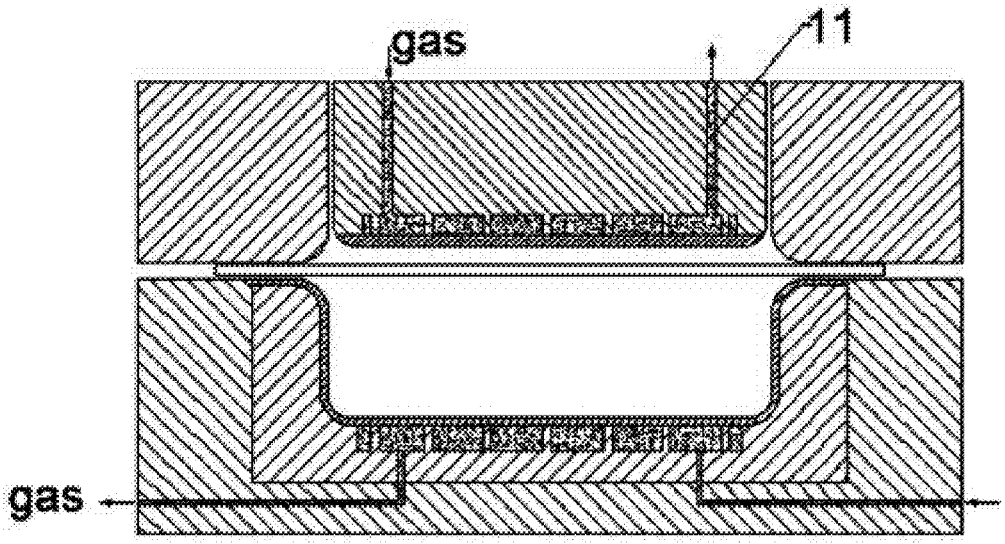
FIGS. 4A-4D are views showing the working principle of a second die of a die capable of achieving rapid forming and quenching therein according to the present invention.
Figure 4B:
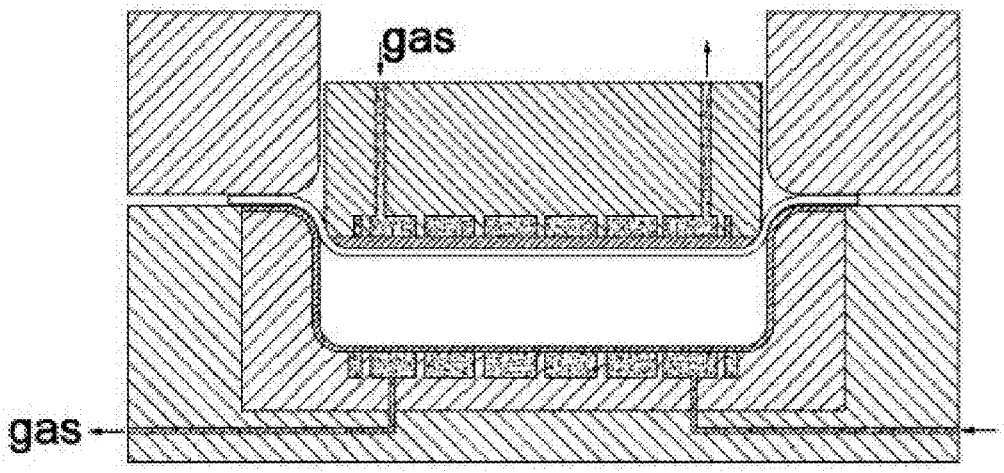
Figure 4C:
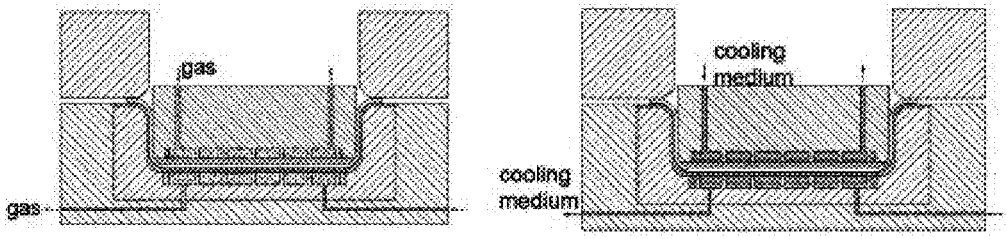
Figure 4D:
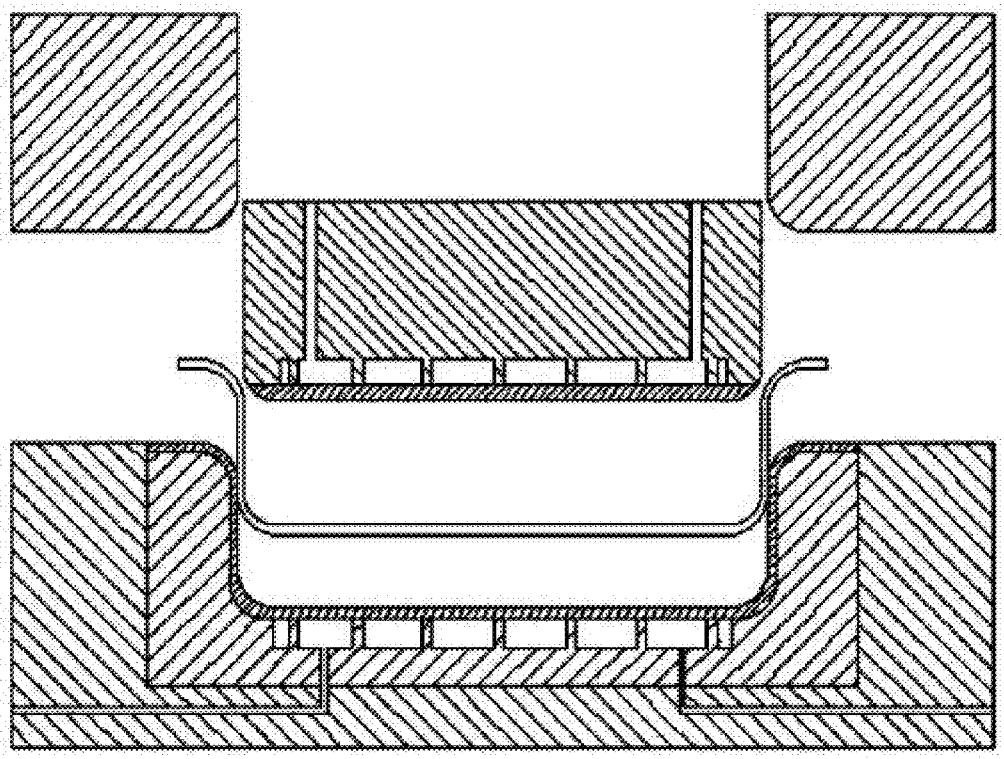

With reference to FIGS. 3 and 4, in another die capable of achieving rapid forming and quenching therein, (1) a forming die includes an upper die and a lower die, where the upper die and the lower die have a combined structure; (2) the upper die and the lower die are each composed of a thin-walled skin and an internal solid die core, and the thin-walled skin closely coats the internal solid die core; (3) the shape and dimensions of the outer surface of the thin-walled skin are the same as those of a part; (4) the surface of the internal solid die core is provided with vertical ribs and grooves communicated with each other, and a specific channel is formed after the thin-walled skin is in contact with the grooves; (5) the internal solid die core is provided with a medium leading-in hole and a leading-out hole, which are connected to the channel formed by the skin and the grooves.

The working process of the above die capable of achieving rapid forming and quenching therein is the same as that of Embodiment 1.

The forming die is composed of an upper die and a lower die, and the forming of a metal slab is achieved through the cooperation of the upper die and the lower die, which can cope with the situation in which the shape is complex and it is impossible or difficult to ensure part shape and dimensions accuracy of a part only by the upper die. When the hot metal slab is in close contact with the upper die and the lower die and a low-temperature medium is introduced into the upper die and the lower die for cooling, the hot metal slab will be rapidly cooled by the thin-walled skin being in contact with the upper and lower surfaces of the hot metal slab, and a higher cooling rate can be obtained. Therefore, effective quenching of a metal slab having a wall thickness of 5 mm or more can be achieved.

Embodiment 3

With reference to FIGS. 1 to 4, according to a die capable of achieving rapid forming and quenching therein according to the present invention, in step 1, a thin-walled skin in a combined die adopts a metal sheet that has good thermal conductivity, small heat capacity, high strength and wear resistance, such as a stainless steel plate, a superalloy plate or a titanium alloy plate. The thin-walled skin has a thickness of 0.2-0.5 mm, the thin-walled skin is in close contact with vertical ribs of an internal solid die core and does not deform during contact with the metal slab. Others are the same as those of Embodiment 1 and Embodiment 2.

Since the skin has a small wall thickness and a small heat capacity, in the forming stage, when the hot metal slab is in contact with the skin, the temperature of the skin will rise quickly, but the skin will not conduct away a lot of heat from the hot metal slab, thereby avoiding causing a rapid drop in the temperature of the hot metal slab. The use of the die structure can not only avoid the temperature drop of the hot slab that is caused by the contact with a cold die and affects the forming property, but also avoid the unreasonable temperature distribution caused by the local temperature drop of the hot metal slab. Therefore, the hot metal slab can be deformed under a sufficiently high temperature and a reasonable temperature distribution.

Embodiment 4

With respect to FIGS. 1 to 4, in a die capable of achieving rapid forming and quenching therein according to the present invention, in step 1, an internal solid die core in a combined die is made of ordinary cast iron, a hard plastic or a wood material. Others are the same as those of Embodiment 1 and Embodiment 2.

Since the internal solid die core is not in directly contact with the hot metal slab, serious friction and wear are avoided; and since the internal solid die core is only subjected to contact pressure from the thin-walled skin, the internal solid die core is only required to have a certain compressive strength. Therefore, the internal solid die core can be made of an ordinary cast iron material, and the internal solid die core can also be made of a hard plastic or a wood material in the sample piece pilot stage or when the forming quality is not high. With this die structure, the design and machining cycle of the die can be greatly shortened, and the die manufacturing cost can be greatly reduced.

Embodiment 5

With reference to FIGS. 1 to 4, in a die capable of achieving rapid forming and quenching therein according to the present invention, in step 3, the thin-walled skin slab can be pressed by using a solid core die with vertical ribs on the surface and grooves, and the thin-walled skin slab can also be pressed by using a solid core die where vertical ribs and grooves are machined, thereby obtaining a required thin-walled skin. Others are the same as those of Embodiment 1 and Embodiment 2.

The wall thickness of the skin is only 0.2-0.5 mm, and a thin-walled skin slab can be pressed using the internal solid core die to obtain a required final thin-walled skin. Since the skin is machined by using a sheet slab with a high surface quality, it is only necessary to initially machine the shape of the inner solid core die, and it is no longer necessary to use a precision machining machine and a grinding machine to ensure the surface roughness and the like of the skin. With this die structure, the machining cycle of the die can be greatly shortened, and the die manufacturing cost can be greatly reduced.

Embodiment 6

With reference to FIGS. 1 to 4, in a die capable of achieving rapid forming and quenching therein according to the present invention, in step 4, there is no connection between a thin-walled skin and an internal solid core die, or a vertical rib of the solid core die is provided with a sealing material of 0.5-1.0 mm to achieve a close fit between a groove and the skin. Others are the same as those of Embodiment 1 and Embodiment 2.

Since the thin-walled skin and the internal solid die core have a split combined structure, there is no connection or only simple connection between the two, and the thin-walled skin can be quickly removed from the internal solid die core. With this die structure, it is possible to avoid the waste caused by the need to replace the whole die resulting from by local friction and wear of a die cavity or unreasonable partial design and the like. At the same time, when the thin-walled skin is subjected to friction and wear, has an unsuitable thickness or has an unsuitable material, it is also very easy to replace the thin-walled skin.

Embodiment 7

With reference to FIGS. 1 to 4, in a die capable of achieving rapid forming and quenching therein according to the present invention, in step 5, before the heated metal slab is quickly placed on the forming die, a gas with a certain pressure is introduced into the groove between the thin-walled skin and the solid die core. Others are the same as those of Embodiment 1 and Embodiment 2.

A gas with certain pressure such as air or nitrogen is introduced into the groove between the thin-walled skin and the solid die core. Due to the poor thermal conductivity of the gas, the effective separation between the thin-walled skin and the solid die core can be achieved, the thin-walled skin which is in contact with and heated by the hot slab is prevented from exchanging a lot of heat with the solid die core, thereby ensuring that the heat of the hot slab in the forming stage is no longer transferred in large quantities, avoiding causing a drop in temperature.

Embodiment 8

With reference to FIGS. 1 to 4, in a die capable of achieving rapid forming and quenching therein according to the present invention, in steps 5-7, the original thickness of a metal slab can vary from 0.2 mm to 5.0 mm. Others are the same as those of Embodiment 1 and Embodiment 2.

Since the temperature of the metal slab in the forming stage does not rapidly decrease, and the material has low flow stress and high forming property in a hot state, and the forming of a part with a complex shape and structure can be achieved. Due to the rapid heat exchange between the low-temperature medium and the hot part during the quenching stage, a sufficiently high cooling rate and effective quenching can be achieved. Therefore, this die structure can be used not only for the forming and quenching of a plate with a medium thickness (a thickness of 0.5-5.0 mm), but also for the forming and quenching of a thick plate (with a thickness of 5-20 mm) and a sheet (with a thickness of 0.2-0.5 mm).

Embodiment 9

With reference to FIGS. 1 to 4, in a die capable of achieving rapid forming and quenching therein according to the present invention, in steps 1-4, the material of the thin-walled skin is a stainless steel sheet, a titanium alloy sheet or a superalloy sheet. Others are the same as those of Embodiment 1 and Embodiment 2.

The beneficial effects of this embodiment are that the thin-walled skin can be reasonably selected according to the material type, wall thickness and forming temperature and the like of the formed metal slab. When the metal slab forming temperature is 200-450° C. (such as an aluminum alloy slab), a 304 or 306 stainless steel sheet can be used as the thin-walled skin. When the metal slab forming temperature is 500-900° C. (such as high-strength steel 22MnB5), a TC4 or TA2 titanium alloy sheet or a GH4169 superalloy sheet can be used as a thin-walled skin. With this die structure, the forming of different metal thin-walled parts can be realized, and the range of applicable materials is wide.

Embodiment 10

With reference to FIGS. 1 to 4, in a die capable of achieving rapid forming and quenching therein according to the present invention, in step 6: the die is kept closed, a low-temperature medium is quickly introduced into a channel composed of the thin-walled skin and the internal solid die core 1, such as cold water at 5-20° C. or liquid nitrogen. Others are the same as those of Embodiment 1 and Embodiment 2.

When the metal slab has a smaller wall thickness, ice water with a temperature of 5-10° C. can be introduced into the groove; when the metal slab has a larger wall thickness, cold air with a temperature of −50-−100° C. or liquid nitrogen with a temperature of −196° C. can be introduced into the groove. Since the skin has a small wall thickness and a small heat capacity, in the quenching stage, when a low-temperature medium is introduced into the groove between the thin-walled skin and the internal solid die core, the temperature of the thin-walled skin is rapidly lowered. Since the skin is good in thermal conductivity, the heat of the hot metal slab can be quickly transferred to a low-temperature medium on the other side through the thin-walled skin, and the hot metal slab is continuously and quickly cooled as the low-temperature medium flows. The use of the die structure can meet the quenching requirements for metal slabs made of different materials and with different wall thicknesses, and the range of applicable materials and parts is wide.

Embodiment 11

With reference to FIGS. 1 to 4, in a die capable of achieving rapid forming and quenching therein according to the present invention, in step 2, grooves machined on the surface of an internal solid die core have different geometrical dimensions and irregular distributions. Others are the same as those of Embodiment 1 and Embodiment 2.

Since the grooves on the surface of the solid die core are easy to machine, the grooves with specific shapes and geometric dimensions can be machined on the surface of an internal solid core die as needed and arranged as needed, and a low-temperature medium in each groove can pass through identical or different leading-in holes and leading-out holes. With this die structure, different temperature distributions can be achieved in the groove composed of the thin-walled skin and the internal core die during the quenching phase, thereby achieving different cooling rates on the hot metal part, which makes it possible to obtain different mechanical property distributions by flexibly controlling quenching effects of regions on the metal part.

What is claimed is:

1. A die configured to achieve rapid forming and quenching therein, comprising an internal solid die core, an upper thin-walled skin, a blank holder and a lower die, wherein the internal solid die core and the upper thin-walled skin move up and down in the blank holder after being combined; the lower surface of the internal solid die core is provided with a plurality of upper grooves, and the upper grooves are separated from each other through vertical ribs integrated with the internal solid die core and are in communication with each other; the upper surface of the internal solid die core is provided with an upper leading-in hole and an upper leading-out hole which lead to the upper grooves, the upper leading-in hole is used for injecting a low-temperature medium into the upper grooves, and the leading-out hole is used for leading out the low-temperature medium after heat exchange; the surface of the upper groove is covered with an upper thin-walled skin, which is fixed on the internal solid die core; the lower surface of the upper thin-walled skin is attached to the upper surface of a hot metal slab, and the hot metal slab is quickly cooled and quenched after the forming is completed;

wherein the inner surface of the lower die is provided with a lower groove, and the lower groove is arranged in the same manner as the upper groove, the surface of the lower groove is covered with a lower thin-walled skin, which is fixed on the inner surface of the lower die; the lower die is provided with a lower leading-in hole and a lower leading-out hole which lead to the lower groove, the lower leading-in hole is used for injecting a low-temperature medium into the lower groove, and the lower leading-out hole is used for leading out the low-temperature medium after heat exchange; in the forming stage, a gas with certain pressure is introduced into the groove between the thin-walled skin and the solid die core; after the forming is completed, the lower surface of the upper thin-walled skin and the upper surface of the lower thin-walled skin are simultaneously in contact with the hot metal slab, and the surface of the hot metal slab is rapidly cooled to complete the quenching;

wherein the shape and dimensions of the outer surface of the thin-walled skin are the same as those of a part to be formed, and the selected material is a stainless steel plate, a superalloy plate or a titanium alloy plate, with a thickness of 0.2-0.5 mm; and the thin-walled skin is in close contact with the vertical ribs of the internal solid die core, and is not deformed during contact with the hot metal slab.

2. The die according to claim 1, wherein the depth of the groove is 2-10 mm, and the distance between adjacent vertical ribs is 5-30 mm.

* * * * *